US007654411B2

(12) United States Patent
Boots et al.

(10) Patent No.: US 7,654,411 B2
(45) Date of Patent: Feb. 2, 2010

(54) CONTAINER WITH LOCKABLE LID

(75) Inventors: Ira G. Boots, Evansville, IN (US); David J. Jochem, Evansville, IN (US); Donald A. Scott, Wadesville, IN (US); William M. Hall, Wadesville, IN (US); Charles L. Williams, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 431 days.

(21) Appl. No.: 11/145,916

(22) Filed: Jun. 6, 2005

(65) Prior Publication Data

US 2006/0000833 A1 Jan. 5, 2006

Related U.S. Application Data

(60) Provisional application No. 60/578,004, filed on Jun. 8, 2004.

(51) Int. Cl.
*B65D 45/22* (2006.01)
*B65D 43/16* (2006.01)

(52) U.S. Cl. ..... 220/835; 220/326; 220/788; 215/237

(58) Field of Classification Search ..... 215/235, 215/237; 220/326, 835, 789, 839, 788
See application file for complete search history.

(56) References Cited

U.S. PATENT DOCUMENTS

| | | | | |
|---|---|---|---|---|
| 2,142,636 | A | | 1/1939 | Evensen |
| 3,209,963 | A | | 10/1965 | Krieps et al |
| 3,623,622 | A | | 11/1971 | Sullivan |
| 3,684,116 | A | | 8/1972 | Duffy |
| 3,699,295 | A | | 10/1972 | Shinohara et al |
| 3,704,802 | A | | 12/1972 | Schultz |
| 3,826,394 | A | | 7/1974 | Stull |
| 3,853,237 | A | | 12/1974 | Marchant |
| 3,865,267 | A | | 2/1975 | Morris |
| 3,902,628 | A | | 9/1975 | Schurman |
| 4,022,352 | A | * | 5/1977 | Pehr ..... 222/153.14 |
| 4,036,385 | A | | 7/1977 | Morris |
| 4,127,221 | A | | 11/1978 | Vere |
| 4,170,315 | A | * | 10/1979 | Dubach et al. ..... 220/281 |
| 4,429,800 | A | | 2/1984 | Greenspan |
| 4,678,080 | A | * | 7/1987 | Nelson ..... 206/387.1 |
| 4,838,441 | A | | 6/1989 | Chernack |
| 4,940,167 | A | | 7/1990 | Fillmore et al. |
| 4,986,438 | A | * | 1/1991 | Borst ..... 220/315 |
| 5,040,691 | A | | 8/1991 | Hayes et al. |
| 5,100,015 | A | | 3/1992 | Vanderstuyf |
| 5,353,946 | A | * | 10/1994 | Behrend ..... 220/326 |
| 5,507,406 | A | * | 4/1996 | Urciuoli et al. ..... 220/269 |
| 5,853,093 | A | * | 12/1998 | Neiger ..... 215/237 |

(Continued)

OTHER PUBLICATIONS

International Search Report dated Nov. 26, 2007, International Application No. PCT/US05/19937.

*Primary Examiner*—Anthony Stashick
*Assistant Examiner*—James N Smalley
(74) *Attorney, Agent, or Firm*—Barnes & Thornburg LLP

(57) ABSTRACT

A container includes a receptacle, a lid, and a lid lock. The lid is arranged to move between an opened position uncovering an opening formed in the receptacle and a closed position covering the opening. The lid lock is used to lock the lid in the closed position.

10 Claims, 7 Drawing Sheets

U.S. PATENT DOCUMENTS 7,404,495 B2 * 7/2008 Keung ..... 215/237
2003/0085228 A1 * 5/2003 Oakes ..... 220/302
2003/0116879 A1 6/2003 Mueller et al.

* cited by examiner

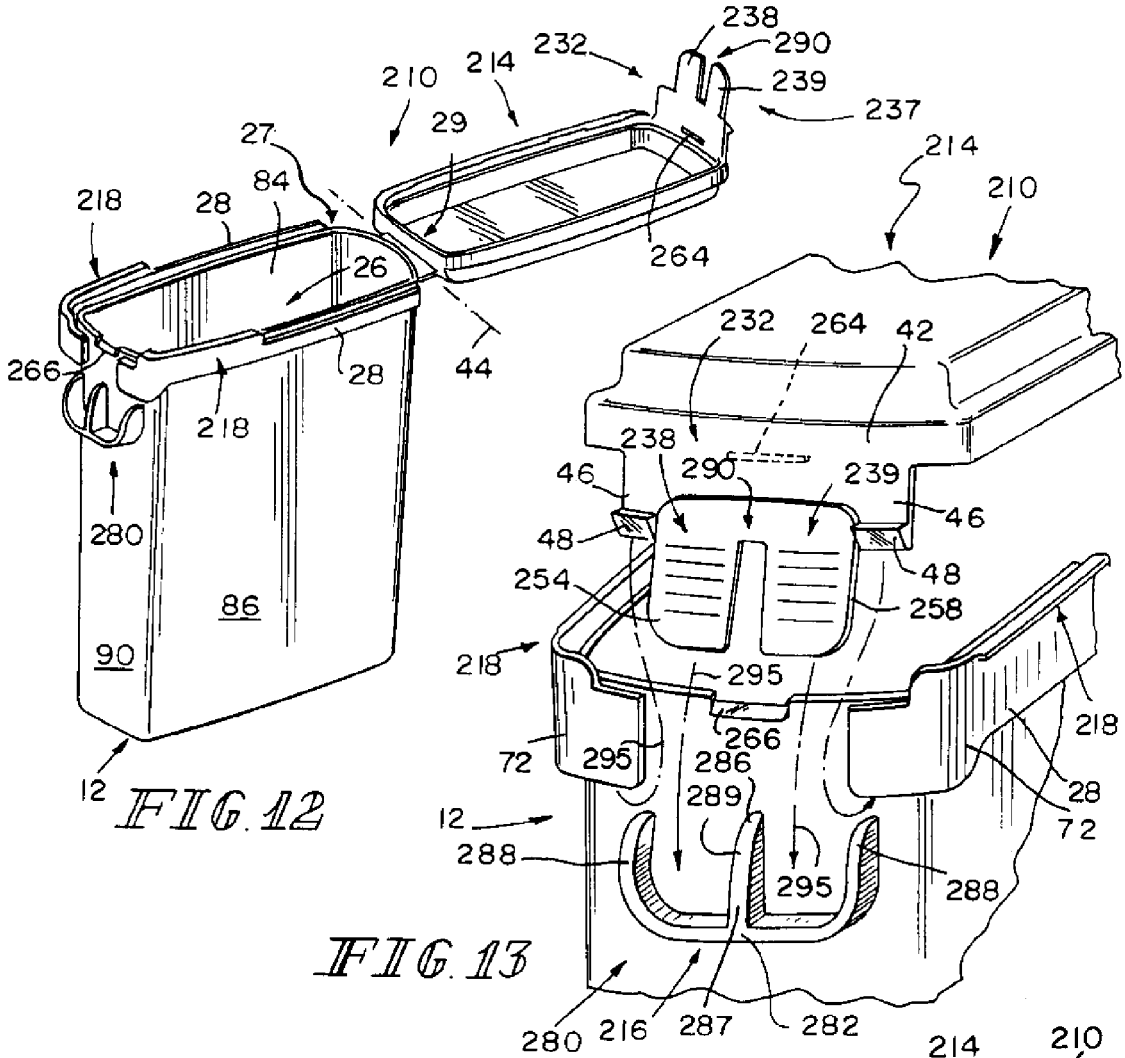
FIG. 12
FIG. 13
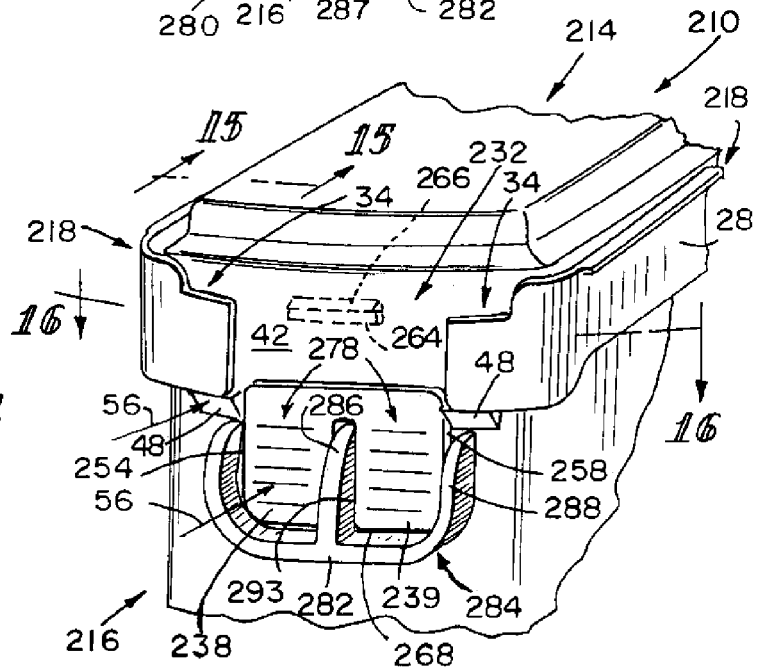
FIG. 14

CONTAINER WITH LOCKABLE LID

This application claims priority to U.S. Provisional Application No. 60/578,004 which was filed Jun. 8, 2004 and is hereby incorporated by reference herein.

BACKGROUND

The present disclosure relates to containers. More particularly, the present disclosure relates to containers with a lockable lid.

Containers are used to store a variety of materials. Lids are often used on containers to retain the contents of the container inside the container.

SUMMARY

According to the present disclosure, a container includes a receptacle, a lid, and a lid lock. The lid can move relative to the receptacle between an opened position uncovering an opening formed in the receptacle and a closed position covering the opening. The lid lock is used to lock the lid in the closed position.

The lid lock includes a pair of spaced-apart latch retainers coupled to the receptacle and an actuator coupled to the lid and flanked by a pair of latches. The actuator is arranged to release the latches from the latch retainers to unlock the lid so that the lid can be moved from the closed position to the opened position.

The actuator may be configured in a variety of ways. In one example, it takes the form of a single release tab coupled to and positioned between the two latches and configured to be operated by a single digit of a person to open the lid. In another example, the actuator includes two adjacent release tabs configured to be operated by two digits of a person to open the lid.

An actuator guard may be used with either actuator configuration to inhibit peripheral access to the actuator and thus unintended opening of the lid. In the case of the single-tab actuator, the guard is configured, for example, as a U-shaped rib. In the case of the dual-tab actuator, the guard is configured, for example, as a W-shaped rib.

The lid lock may also include a pair of locking tangs coupled to side walls of the receptacle. The locking tangs normally do not inhibit opening and closing of the lid. However, when the side walls are deformed inwardly into the receptacle interior region, the locking tangs move inwardly therewith to engage opposite sides of the lid to inhibit opening of the lid. The locking tangs thus act to lock the lid in the closed position in response to inward deformation of the side walls.

Additional features of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which:

FIG. 12 is a perspective view showing a third container including a lid lock that includes a dual-tab actuator coupled to a lid, a latch coupled to each tab of the actuator, and a latch retainer provided for use with each latch and coupled to a receptacle of the container and showing a W-shaped actuator guard coupled to the receptacle;

FIG. 13 is a perspective view of the container of FIG. 12, with portions broken away, showing the lid moving to the closed position;

FIG. 14 is a front elevation view of the container of FIGS. 12 and 13, with portions broken away, showing the lid in the closed position due to engagement between the latches and the latch retainers and showing the tabs of the actuator received by the actuator guard to inhibit peripheral access to the tabs;

DETAILED DESCRIPTION

Figure 1:
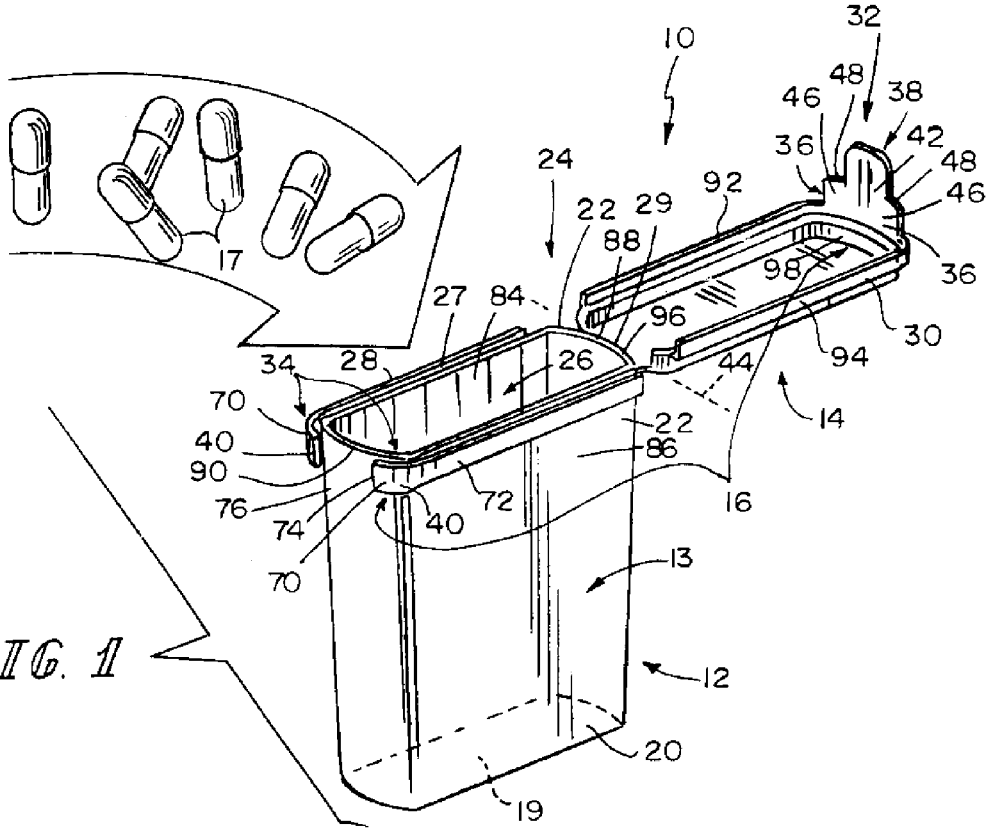
FIG. 1 is a perspective view showing a first container including a receptacle, a lid hinged to the receptacle at one end in an opened position for reception of pills or other substances in the receptacle, and a lid lock including a body coupled to the other end of the lid and a body receiver coupled to the receptacle to receive the body to lock the lid in a closed position as shown in FIGS. 2 and 3.
Figure 2:
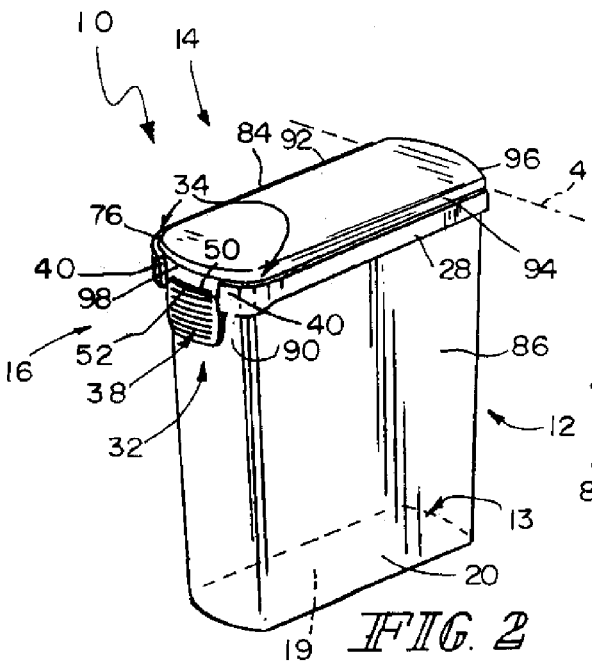
FIG. 2 is a perspective view of the container of FIG. 1 showing the lid in the closed position.

A container 10 includes a receptacle 12, a lid 14, and a lid lock 16 as shown in FIGS. 1 and 2. Lid 14 is arranged to move relative to receptacle 12 between an opened position uncovering an opening 24 formed in receptacle 12, as shown, for example, in FIG. 1, and a closed position covering opening 24, as shown, for example, in FIG. 2. Lid lock 16 is used to lock lid 14 in the closed position to promote tamper-resistance of container 10. Lid lock 16 thus provides means for locking lid 14 in the closed position.

Receptacle 12 is arranged to receive a substance 17 for storage therein, as shown, for example, in FIG. 1. Substance 17 is, for example, medicine in the form of capsules and/or tablets.

Receptacle 12 includes a receptacle sleeve 13 including a lower portion 20 coupled to a bottom wall 19 and an upper portion or rim 22. Rim 22 is formed to include opening 24 that opens into an interior region 26 formed in receptacle 12 and surrounded by receptacle sleeve 13. An L-shaped rim receiver flange 28 cooperates with rim 22 to form a U-shaped channel 27 therebetween. U-shaped channel 27 is configured to receive a rim 30 of lid 14 when lid 14 is in the closed position.

Illustratively, receptacle sleeve 13 is generally rectangular, as shown, for example, in FIGS. 1 and 2. Receptacle sleeve 13 includes first and second side walls 84, 86 spaced apart from one another and first and second end walls (or rear and front walls) 88, 90 spaced apart from one another. First and second end walls 88, 90 are shorter than first and second side walls 84, 86. First and second end walls 88, 90 interconnect first and second side walls 84, 86 so that first and second side walls 84, 86 and first and second end walls 88, 90 cooperate to surround interior region 26.

Lid 14 is arranged to move relative to receptacle 12 between the opened position uncovering opening 24 and the closed position covering opening 24, as shown, for example, in FIGS. 1 and 2. Lid 14 is coupled to receptacle 12 by use of a hinge 29 for pivotable movement relative to receptacle 12 about a pivot axis 44 between the opened and closed positions.

Illustratively, a lid rim 30 included in lid 14 is generally rectangular, as shown, for example, in FIGS. 1 and 2. Lid rim 30 includes first and second sides 92, 94 spaced apart from one another and first and second ends 96, 98 spaced apart from one another. First and second ends 96, 98 are shorter than first and second sides 92, 94. First and second ends 96, 98 interconnect first and second sides 92, 94. First end 96 is coupled to first end wall 88 for pivotable movement of lid 14 relative to receptacle 12 between the opened position shown, for example, in FIG. 1 and the closed position shown, for example, in FIG. 2.

Lid lock 16 includes body 32 and a body receiver 34, as suggested, for example, in FIGS. 1 and 2. Body 32 is coupled to lid rim 30. Body receiver 34 is coupled to receptacle rim 28 and is arranged to receive body 32 to lock lid 14 in the closed position upon movement of lid 14 from the opened position to the closed position, as shown, for example, in FIG. 2.

Body 32 includes a mount 42 configured as a wall cantilevered to second end 98, a pair of spaced-apart latches 36, and an actuator 38 situated therebetween. Illustratively, actuator 38 is a release tab arranged for unlocking lid 14 upon application of an actuation force 56 to tab 38.

Each latch 36 includes a latch arm 46 and a lug 48, as shown, for example, in FIGS. 3-7. Each latch arm 46 is coupled to and extends from mount wall 42. Each lug 48 is coupled to and extends outwardly from its companion latch arm 46.

Release tab 38 is coupled to and extends from mount wall 42, as shown, for example, in FIGS. 1-7. Illustratively, release tab 38 is generally rectangular and includes a first side edge 54, a second side edge 58, a top edge 66, and a bottom edge 68. First side edge 54 is coupled to and engages a first of the latch arms 46 and first of the lugs 48 and extends outwardly from the first latch arm 46. Second side edge 58 is coupled to and engages a second of the latch arms 46 and a second of the lugs 48 and extends outwardly from the second latch arm 46. Top edge 66 interconnects first and second side edges 54, 58 and extends outwardly from mount wall 42. Bottom edge 68 interconnects first and second side edges 54, 58 and is positioned farther away from mount wall 42 than latches 36.

Release tab 38 includes an outer surface 78, as shown, for example, in FIGS. 3-7. Outer surface 78 faces away from receptacle 12 and interconnects first side edge 54, second side edge 58, top edge 66, and bottom edge 68. Surface 78 is textured to inhibit slippage of a user's thumb or finger thereon when unlocking and opening lid 14. Illustratively, surface 78 includes a plurality of ribs 52 which are spaced apart from one another and parallel to pivot axis 44.

Figure 3:
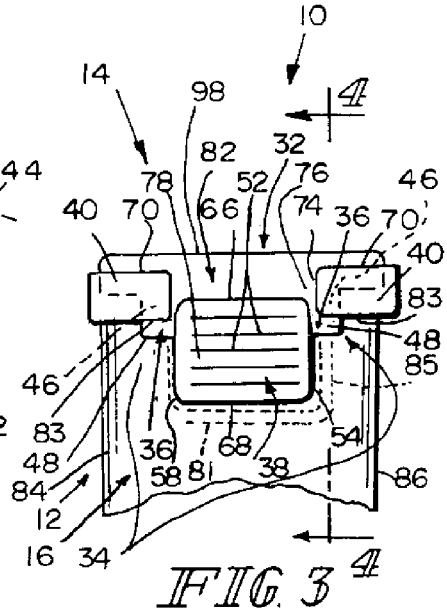
FIG. 3 is a front elevation view of the container of FIGS. 1 and 2, with portions broken away, showing the lid in the closed position due to engagement between a pair of latches included in the body and a pair of spaced-apart latch retainers included in the body receiver and showing an actuator configured, for example, as a single tab positioned between and coupled to the latches to cause release of the latches from the latch retainers to unlock the lid upon application of an actuation force to the actuator so that the lid can be opened as shown in FIGS. 5-7.

Body receiver 34 includes a pair of spaced-apart latch retainers 40 arranged to receive body 32 upon movement of lid 14 to the closed position, as shown, for example, in FIG. 3. Each latch retainer 40 is configured, for example, as an arm including a proximal portion 72 coupled to receptacle 12, and a distal portion 74 spaced apart from receptacle 12. Latch retainers 40 extend toward one another as each latch retainer 40 extends from its proximal portion 72 to its distal portion 74, as shown, for example, in FIG. 3. Distal portions 74 are spaced apart from one another thus forming a gap 76 therebetween. Arms 40 and receptacle rim 28 cooperate to form a channel 82 therebetween.

Figure 4:
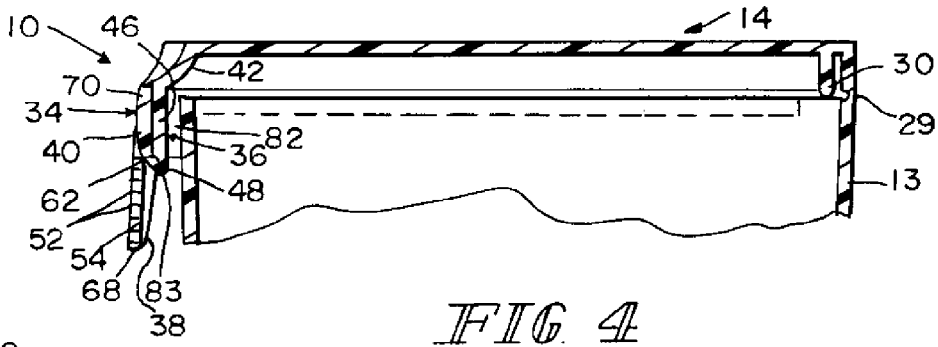
FIG. 4 is a sectional view taken along lines 4-4 of FIG. 3 showing engagement between one of the latches and one of the latch retainers to lock the lid in the closed position.

Body receiver 34 receives body 32 to lock lid 14 in the closed position, as shown, for example, in FIG. 4. Engagement between lugs 48 and latch retainers 40 causes latches 36 to deflect inwardly toward receptacle 12 as latches 36 pass through channel 82 during pivotable movement of lid 14 from the opened position to the closed position. After lugs 48 pass through channel 82, latches 36 deflect outwardly away from receptacle 12 for engagement between lugs 48 and undersides 83 of retainers 40. Such engagement between lugs 48 and underside 83 locks lid 14 in the closed position. When lid 14 is locked in the closed position, release tab 38 extends from latch arms 46 located in channel 82 through gap 76 for ready access thereto.

Figure 5:
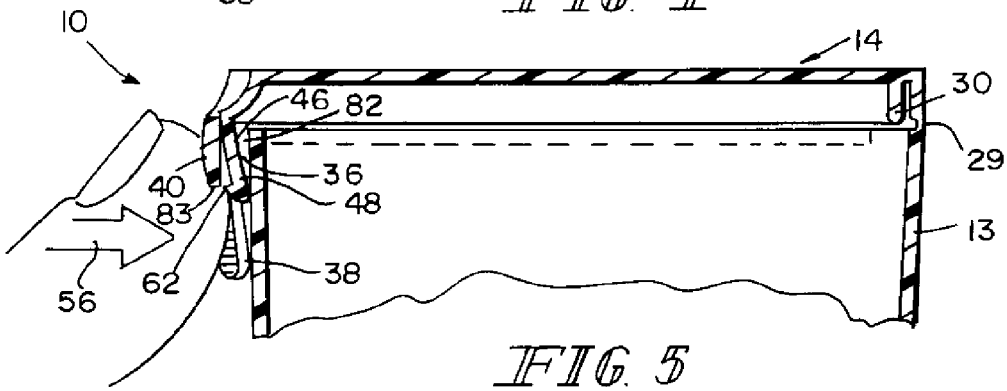
FIG. 5 is a sectional view similar to FIG. 4 showing a user's thumb applying an actuation force to the actuator to press the actuator inwardly to release the latch from the latch retainer to unlock the lid.
Figure 6:
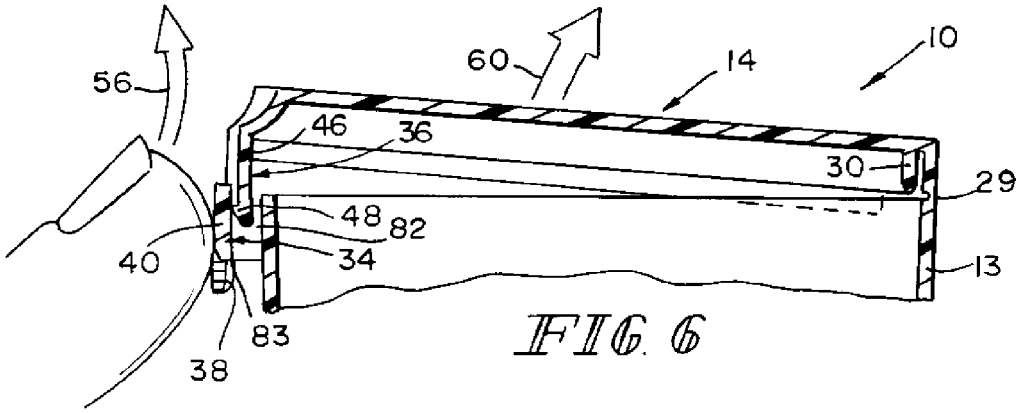
FIG. 6 is a sectional view similar to FIG. 5 showing the user's thumb pressing the actuator upwardly to pivot the lid upwardly toward the opened position.
Figure 7:
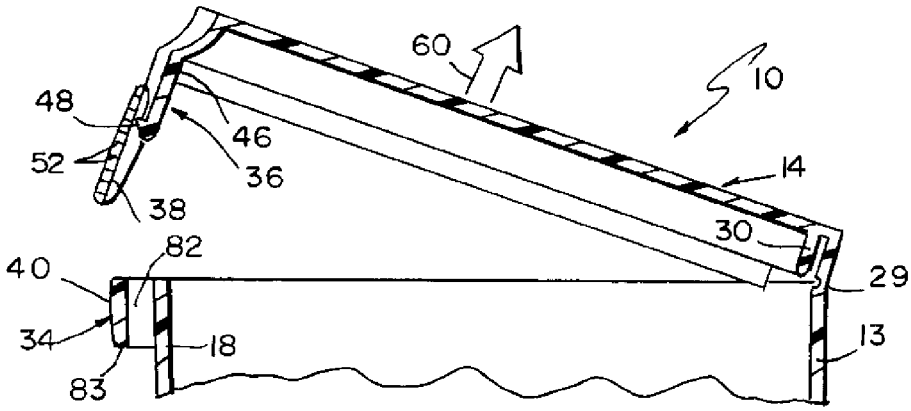
FIG. 7 is a sectional view similar to FIG. 6 showing pivotable movement of the lid toward the opened position.

The user can apply actuation force 56 to release tab 38 to unlock lid 14 for movement of lid 14 from the opened position to the closed position, as shown, for example, in FIGS. 5-7. Inward application of actuation force 56 to release tab 38 causes release tab 38 to move inwardly toward receptacle 12. Such movement of release tab 38 deflects latches 36 inwardly therewith so that lugs 48 clear undersides 83 so as to be released therefrom, thereby unlocking lid 14. Upward application of actuation force 56 to release tab 38 causes latches 36 to be withdrawn from channel 82 and lid 14 to pivot about axis 44 in an opening direction 60 from the opened position toward the closed position.

Container 10 is made, for example, by injection molding a plastics material (e.g., polyolefin resin). Container 10 is, for example, a monolithic, one-piece structure.

It is within the scope of this disclosure for container 10 to include an actuator guard 81 formed on receptacle front wall 90 of receptacle sleeve 13 and arranged to guard tab 38 to inhibit peripheral access thereto and thus inhibit unintended opening of lid 14 when lid 14 is locked in the closed position, as suggested, for example, in FIG. 3. Actuator guard 81 is arranged to inhibit unintended opening of container 10 by, for example, a toddler who might attempt to pry tab 38 away from sleeve 13 by inserting a digit or tooth around the periphery of tab 38. Illustratively, guard 81 is configured as a generally U-shaped rib extending outwardly from front wall 90 and along peripheral edges 54, 58, 68 of tab 38 so as to receive tab 38 within guard 81.

Container 10 may be arranged, for example, having a generally rectangular actuator 38 and an actuator guard 81, as shown in phantom in FIG. 3. Actuator guard 81 includes a U-shaped rib 85 coupled to front wall 90 and arranged to extend along at least a portion of bottom edge 68 and opposite side edges 54, 58 of actuator 38 when lid 14 is in the closed position.

Figure 8:
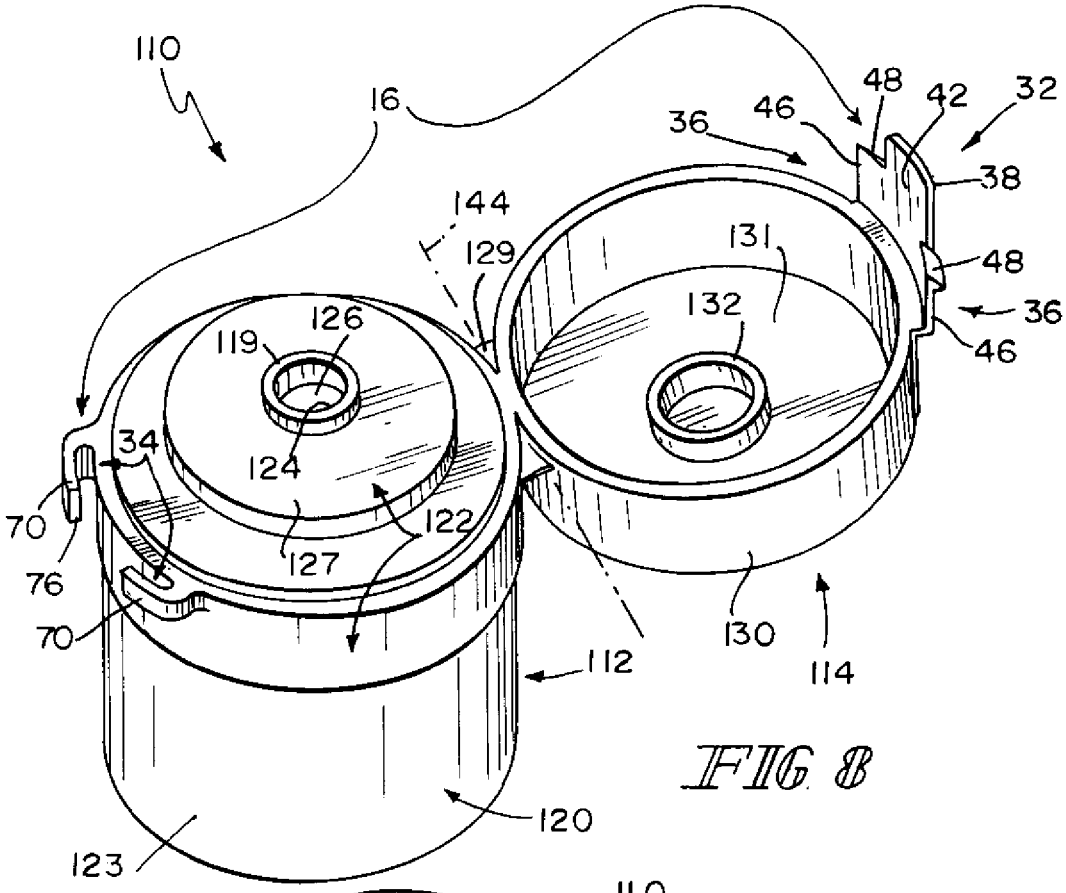
FIG. 8 is a perspective view showing the lid lock used with a lid of a second container for storing liquids or other substances.
Figure 9:
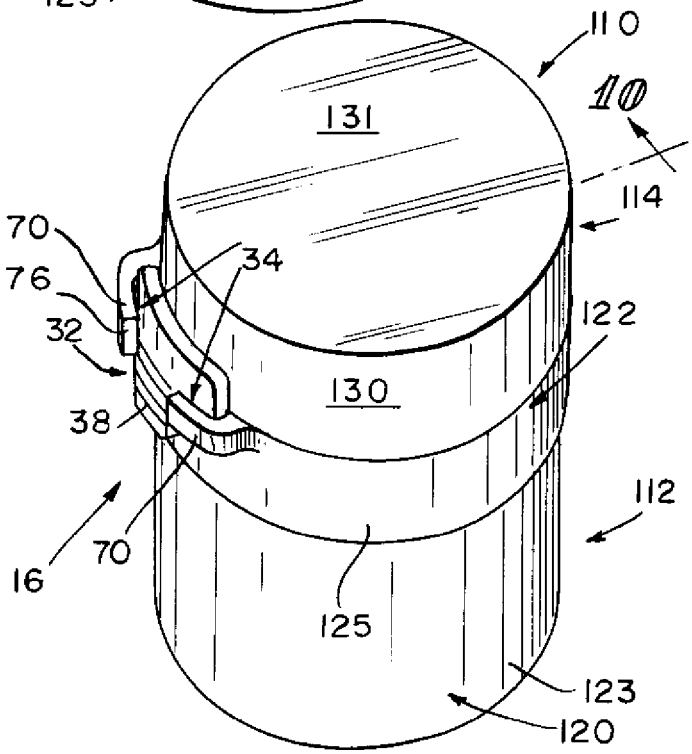
FIG. 9 is a perspective view showing use of the lid lock of FIG. 8 to lock the lid in a closed position.
Figure 10:
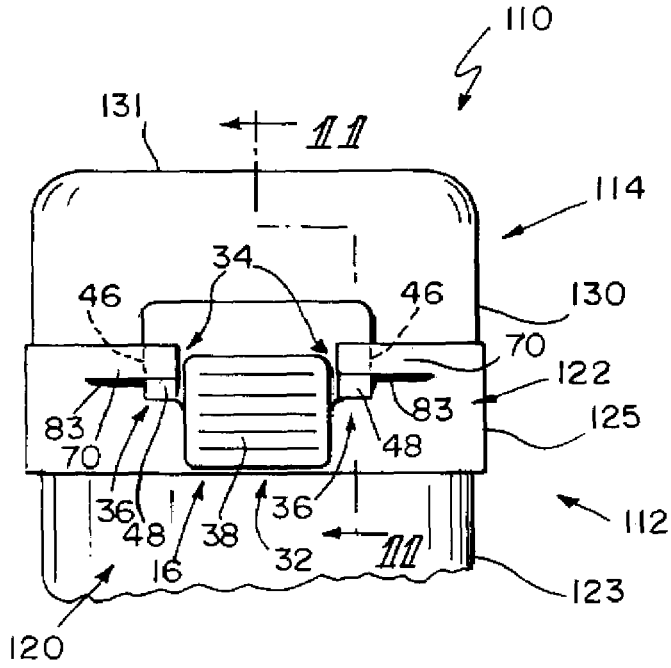
FIG. 10 is a front elevation view of the container of FIGS. 8 and 9.
Figure 11:
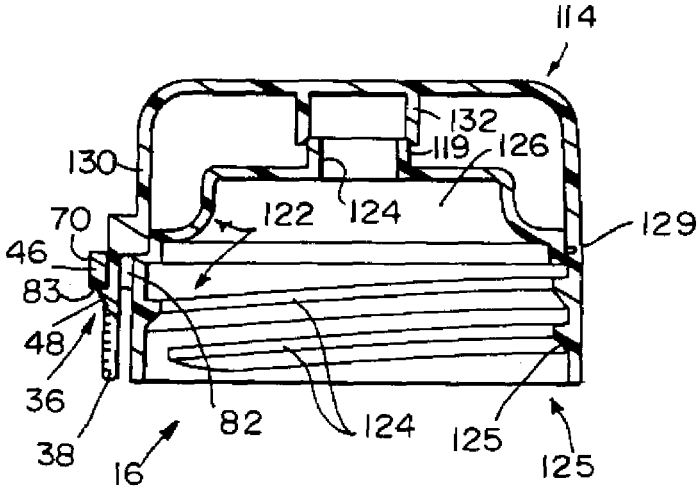
FIG. 11 is a sectional view taken along lines 11-11 of FIG. 10.

Lid lock 16 is useful with a second container 110 configured to store a substance such as liquid, as shown, for example, in FIGS. 8-10. Lid lock 16 is arranged to move relative to a receptacle 112 between an opened position uncovering an opening 124 formed in receptacle 112, as shown, for example, in FIG. 8, and a closed position covering opening 124, as shown, for example, in FIGS. 9-11. Lid lock 16 is used to lock lid 114 in the closed position to promote tamper-resistance of container 110. Lid lock 16 thus provides means for locking lid 114 in the closed position.

Receptacle 12 includes a lower portion 120 and an upper portion 122, as shown, for example, in FIGS. 8-10. Lower and upper portions 120, 122 cooperate to provide an interior region 126 of receptacle 12. Lower portion 120 includes a cylindrical lower receptacle sleeve 123. Upper portion 122 includes a cylindrical upper receptacle sleeve 125, an annular upper receptacle wall 127 coupled to upper receptacle sleeve 125, and a central spout 119 coupled to wall 127 and formed to include opening 124 to admit liquid into interior region 126 and discharge liquid therefrom. Illustratively, upper receptacle sleeve 125 is formed to include threads 129 to mate with threads (not shown) formed in lower receptacle sleeve 123 to couple sleeves 123, 125 to one another, as shown, for example, in FIG. 11.

Lid 114 is arranged to move relative to receptacle 112 between the opened position uncovering opening 124 and the closed position covering opening 24, as shown, for example, in FIGS. 8 and 9. Illustratively, lid 114 includes a cylindrical lid rim 130 which is coupled to a lid top wall 131 and coupled to upper portion 122 by use of a hinge 129 for pivotable movement of lid 114 relative to receptacle 112 about a pivot axis 144 between the opened and closed positions. A central spout sleeve 132 is coupled to top wall 131 for engagement with spout 119 therearound when lid 114 assumes the closed position.

Lid lock 16 is coupled to lid rim 130 and upper receptacle sleeve 125, as shown, for example, in FIG. 8. Body 32 is coupled to lid rim 130. Body receiver 34 is coupled to upper receptacle sleeve 125. Lid lock 16 is operable in the manner described in connection with container 10.

Container 10 is made, for example, by injection molding a plastics material (e.g., polyolefin resin). Lid lock 16, lid 114, and upper portion 122 of receptacle 112 cooperate to form a monolithic, one piece structure.

A third container 210 includes a receptacle 12, a lid 14, a lid lock 216, and an actuator guard 280, as shown in FIGS. 12-14. Lid 14 is arranged to move relative to receptacle 12 between an opened position uncovering an opening 24 formed in receptacle 12, as shown, for example, in FIG. 12, and a closed position covering opening 24, as shown, for example, in FIG. 13. Lid lock 216 is used to lock lid 14 in the closed position to promote tamper-resistance of container 10. Lid lock 216 thus provides means for locking lid 214 in the closed position.

Lid lock 216 includes a pair of locking tangs 218 coupled to flanges 28, as shown, for example, in FIGS. 12-15. Locking tangs 218 cooperate to inhibit opening of lid 14 in response to inward deformation of side walls 84, 86 toward one another into interior region 26. For example, tangs 218 are arranged to inhibit opening of lid 14 by a toddler who might attempt to deform walls 84, 86 inwardly toward region 26 to cause receptacle rim 22 to buckle under lid rim 30 so that a digit or tooth could pry open lid 14.

Figure 15:
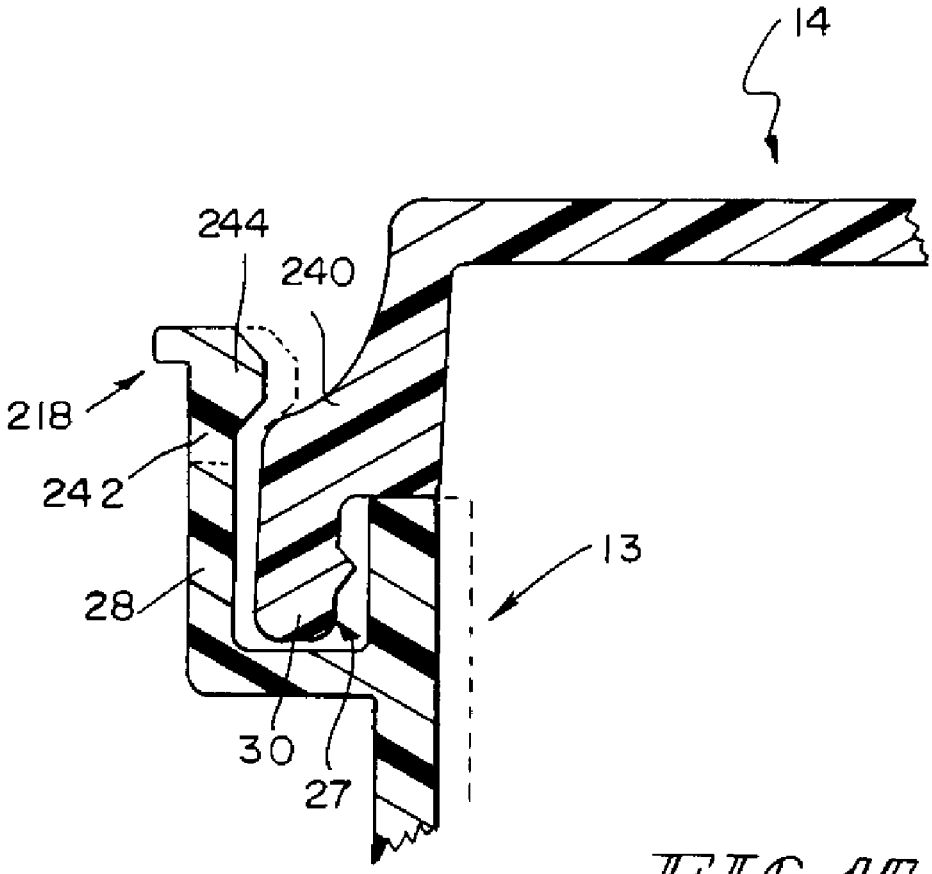
FIG. 15 is a sectional view taken along lines 15-15 of FIG. 14, with portions broken away, showing a locking tang coupled to an upper portion of a rim receiver flange receiving the lid rim nesting in a channel formed between the rim receiver flange and a receptacle sleeve.

Each tang 218 is arranged normally to disengage a step 240 formed in lid 14 and is arranged to engage step 240 upon inward deformation of a side wall 84, 86, as shown, for example, in FIG. 15. Tang 218 extends upwardly from flange 28 and inwardly toward step 240. Tang 218 includes a mount wall 242 extending upward from flange 28 and a bead 244 extending longitudinally along mount wall 242 and inwardly toward step 240. Illustratively, tang 218 extends from a distal end 72 along flange 28 toward hinge 29 about one-third of the length of flange 28.

Lid lock 216 includes a body 232, a body receiver 34, a first locking tang 264, and a second locking tang 266, as suggested, for example, in FIGS. 12 and 13. Body 232 is coupled to lid rim 30. Body receiver 34 is coupled to receptacle rim 22 and is arranged to receive body 232 to lock lid 214 in the closed position upon movement of lid 214 from the opened position to the closed position. First locking tang 264 is formed on an interior-facing surface of body 232. Second locking tang 266 is formed on an upper portion of wall 90 adjacent to rim 22 and arranged so that an upper edge of first locking tang 264 abuts a bottom edge of second locking tang 266 when lid 214 is moved to the closed position covering opening 24. When the user moves lid 214 from the closed position to the opened position, second locking tang 266 inhibits upward movement of first locking tang 264 and lid 214 until sufficient upward force is applied to actuator 237 to allow first locking tang 264 to disengage from second locking tang 266 and allow lid 214 to be moved to the opened position.

Body 232 includes mount 42, the pair of spaced-apart latches 36, and an actuator 237. Mount 42 is a wall cantilevered to second end 98. Illustratively, actuator 237 is a pair of release tabs 238, 239 arranged for unlocking lid 214 upon application of an actuation force 56. Release tabs 238, 239 are formed to include a U-shaped aperture 290 situated therebetween.

Release tabs 238, 239 are coupled to and extend from mount wall 42, as shown, for example, in FIGS. 12-14. Illustratively, release tabs 238, 239 are generally rectangular and include a first side edge 254, a second side edge 258, bottom edges 268, and inner edges 269. First side edge 254 is provided by release tab 238 and is coupled to and engages a first of the latch arms 46 and a first of the lugs 48. Second side edge 258 is provided by release tab 239 and is coupled to and engages a second of the latch arms 46 and a second of the lugs 48. Each bottom edge 268 interconnects a side edge 254, 258 and an inner edge 269, and is positioned farther away from mount wall 42 than latches 36.

Each release tab 238, 239 includes an outer surface 278, as shown, for example, in FIGS. 13-14. Each outer surface 278 faces away from receptacle 12 and interconnects a side edge 254, 258, an inner edge 269, and a bottom edge 268. Surfaces 278 are textured (e.g., with ribs) to inhibit slippage of the user's thumb or finger thereon when unlocking and opening lid 214.

Actuator guard 280 is formed on receptacle front wall 90 of receptacle sleeve 13 and arranged to guard actuator 237 to inhibit peripheral access thereto and thus inhibit unintended opening of lid 14 when lid 14 is locked in the closed position.

Actuator guard 280 is arranged to inhibit unintended opening of container 210 by, for example, a toddler who might attempt to pry actuator 237 away from sleeve 13 by inserting a digit or tooth around the periphery of actuator 237.

Illustratively, actuator guard 280 is configured as a W-shaped rib unit extending outwardly from front wall 90 and along peripheral edges 254, 258, 268, 269 of release tabs 238, 239. As such, actuator guard 280 includes a pair of vertical outer ribs 288, a vertical center rib 286 positioned between outer ribs 288, and a horizontal rib 282 coupled to a bottom end of each rib 286, 288. Outer ribs 288 and horizontal rib 282 cooperate to form a U-shaped rib which is bisected by center rib 286. Center rib 286 includes a lower portion 287 coupled to the U-shaped rib and an upper portion 289. Lower portion 287 is coextensive with the U-shaped rib and upper portion 289 tapers from a width coextensive with lower portion 287 until it is flush with front wall 90. The tapered upper portion 289 of center rib 286 allows an adult user to operate actuator 237 with a single digit while still inhibiting a child having narrower digits from operating actuator 237 with a single digit.

Ribs 282, 286, 288 cooperate to form a pair of tab-receiver recesses 291 arranged to receive tabs 238, 239 when lid 14 is moved in direction 295 to the closed position. Outer ribs 288 extend along first and second side edges 254, 258 of tabs 238, 239, center rib 286 extends along inner edges 269 in an aperture 293 formed therebetween, and horizontal rib 282 extends along bottom edges 268 when lid 14 is in the closed position.

Figure 16:
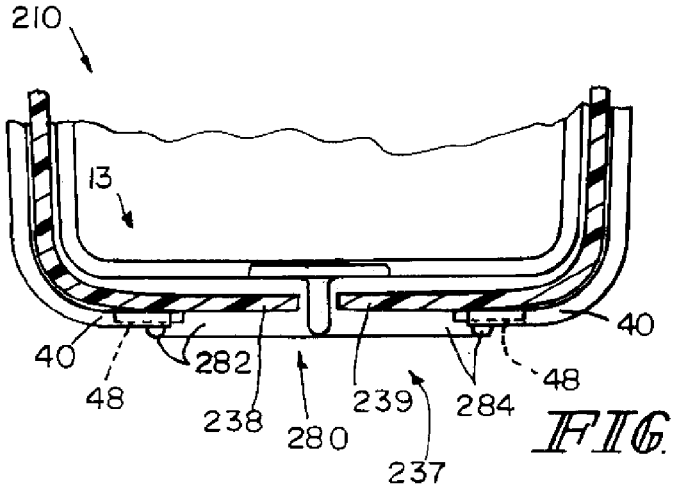
FIG. 16 is a sectional view taken along lines 16-16 of FIG. 14, with portions broken away, showing the tabs of the actuator received by the actuator guard and not actuated so that the lid is locked in the closed position.
Figure 17:
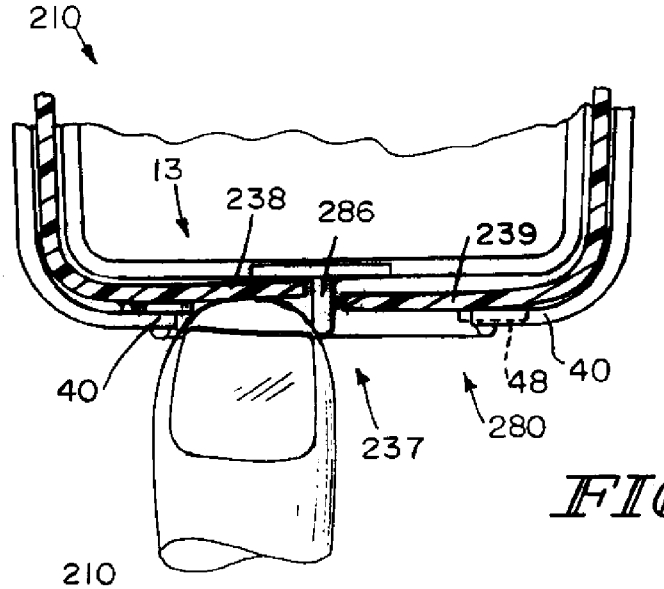
FIG. 17 is a sectional view similar to FIG. 16 showing the user's thumb applying an actuation force to one of the tabs of the actuator while the other tab remains unactuated so that the lid is still locked in the closed position.
Figure 18:
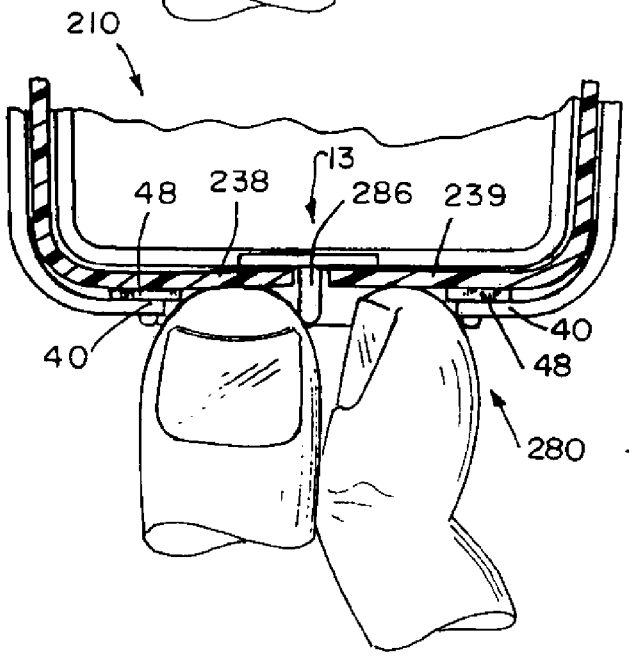
FIG. 18 is a sectional view similar to FIGS. 16 and 17 showing the user's thumb and forefinger applying an actuation force to both actuator tabs to release the latches from the latch retainers to unlock the lid.

The user can apply a simultaneous actuation force 56 to release tabs 238, 239 toward front wall 90 to unlock lid 214 for movement of lid 214 from the closed position to the opened position, as shown, for example, in FIGS. 16 and 17. Inward application of simultaneous actuation force 56 to release tabs 238, 239 causes each release tab 238, 239 to move inwardly toward receptacle 212. Such movement of release tabs 238, 239 deflects latches 36 inwardly therewith so that lugs 48 clear undersides 83 so as to be released therefrom, thereby unlocking lid 214. Upward application of actuation force 56 to release tabs 238 causes latches 36 to be withdrawn from channel 82 and lid 14 to pivot about axis 44 in opening direction 60 from the opened position toward the closed position.

Container 210 is made, for example, by injection molding a plastics material (e.g., polyolefin resin). Container 210 is, for example, a monolithic, one-piece structure.

The invention claimed is:

1. A container comprising a receptacle formed to include an interior region and an opening into the interior region, a lid arranged to move relative to the receptacle between an opened position uncovering the opening and a closed position covering the opening, and a lid lock including first and second latch retainers coupled to the receptacle, first and second latches, and an actuator coupled to the lid and positioned between and coupled to the first and second latches, the first latch being arranged to engage the first latch retainer and the second latch being arranged to engage the second latch retainer so that the first and second latches and the first and second latch retainers cooperate to lock the lid in the closed position, the actuator being arranged to move toward the receptacle to release the first and second latches from the first and second latch retainers to unlock the lid to allow movement of the lid from the closed position to the opened position, and an actuator guard that is coupled to the receptacle and extends along a bottom edge of the actuator and along opposite side edges of the actuator to inhibit access to the actuator when the lid is in the closed position, wherein the actuator guard is configured as a generally W-shaped rib unit coupled to the receptacle.

2. The container of claim 1, wherein the W-shaped rib unit includes three vertical rib in spaced-apart parallel relation to one another and a horizontal rib coupled to a bottom end of each vertical rib, the ribs cooperate to form a pair of recesses, and each recess is arranged to receive a tab included in the actuator when the lid is in the closed position.

3. A container comprising a receptacle formed to include an interior region and an opening into the interior region, a lid arranged to move relative to the receptacle between an opened position uncovering the opening and a closed position covering the opening, and a lid lock including first and second latch retainers coupled to the receptacle, first and second latches, and an actuator coupled to the lid and positioned between and coupled to the first and second latches, the first latch being arranged to engage the first latch retainer and the second latch being arranged to engage the second latch retainer so that the first and second latches and the first and second latch retainers cooperate to lock the lid in the closed position, the actuator being arranged to move toward the receptacle to release the first and second latches from the first and second latch retainers to unlock the lid to allow movement of the lid from the closed position to the opened position, and an actuator guard that is coupled to the receptacle and extends along a bottom edge of the actuator and along opposite side edges of the actuator to inhibit access to the actuator when the lid is in the closed position, wherein the actuator guard includes a generally U-shaped rib bisected by a center rib, the actuator is formed to include an aperture in a center portion of the actuator extending from the bottom edge of the actuator upward toward the lid, and the aperture is arranged to receive the center rib when the lid is in the closed position.

4. A container comprising a receptacle formed to include an interior region and an opening into the interior region, a lid arranged to move relative to the receptacle between an opened position uncovering the opening and a closed position covering the opening, and a lid lock including first and second latch retainers coupled to the receptacle, first and second latches, and an actuator coupled to the lid and positioned between and coupled to the first and second latches, the first latch extending above the actuator and being arranged to engage the first latch retainer and the second latch being arranged to engage the second latch retainer so that the first and second latches and the first and second latch retainers cooperate to lock the lid in the closed position, the actuator being arranged to move toward the receptacle to release the first and second latches from the first and second latch retainers to unlock the lid to allow movement of the lid from the closed position to the opened position, and an actuator guard that is coupled to the receptacle and extends along a bottom edge of the actuator and along opposite side edges of the actuator to inhibit access to the actuator when the lid is in the closed position, wherein the actuator guard is arranged to cover at least a portion of each of the side and bottom edges of the actuator when the actuator is received by the actuator guard.

5. A container comprising a receptacle formed to include an interior region and an opening into the interior region, a lid arranged to move relative to the receptacle between an opened position uncovering the opening and a closed position covering the opening, and a lid lock including first and second latch retainers coupled to the receptacle, first and second latches, and an actuator coupled to the lid and positioned between and coupled to the first and second latches, the first latch being arranged to move between the latch retainer and the receptacle to engage the first latch retainer and the second latch being arranged to engage the second latch retainer so that the first and second latches and the first and second latch retainers cooperate to lock the lid in the closed position, the actuator being arranged to move toward the receptacle to release the first and second latches from the first and second latch retainers to unlock the lid to allow movement of the lid from the closed position to the opened position, and an actuator guard that is coupled to the receptacle and extends along a bottom edge of the actuator and along opposite side edges of the actuator to inhibit access to the actuator when the lid is in the closed position, wherein the actuator is generally rectangular and the actuator guard includes a generally U-shaped rib coupled to the receptacle below the first and second latch retainers and the generally U-shaped rib is arranged to extend along at least a portion of the bottom edge and opposite side edges of the actuator when the lid is in the closed position.

6. A container comprising a receptacle formed to include an interior region and an opening into the interior region, a lid arranged to move relative to the receptacle between an opened position uncovering the opening and a closed position covering the opening, and a lid lock including first and second latch retainers coupled to the receptacle, first and second latches, and an actuator coupled to the lid and positioned between and coupled to the first and second latches, the first latch being arranged to engage the first latch retainer and the second latch being arranged to engage the second latch retainer so that the first and second latches and the first and second latch retainers cooperate to lock the lid in the closed position, the actuator being arranged to move toward the receptacle to release the first and second latches from the first and second latch retainers to unlock the lid to allow movement of the lid from the closed position to the opened position, and an actuator guard that is coupled to the receptacle and extends along a bottom edge of the actuator and along opposite side edges of the actuator to inhibit access to the actuator when the lid is in the closed position, wherein the lid lock includes a first locking tang coupled to a deformable first side wall of the receptacle and arranged to engage the lid to lock the lid in the closed position in response to inward deformation of the first side wall into the interior region.

7. The container of claim 6, wherein the lid lock includes a second locking tang coupled to a deformable second side wall of the receptacle and arranged to engage the lid to lock the lid in the closed position in response to inward deformation of the second side wall into the interior region toward the first side wall.

8. The container of claim 7, wherein the receptacle includes a front wall connecting the first and second side walls, the lid includes first and second side portions and a front portion connecting the first and second side portions, the actuator guard is coupled to the front wall, the first locking tang is arranged to engage the first side portion, and the second locking tang is arranged to engage the second side portion.

9. A container comprising a receptacle formed to include an interior region and an opening into the interior region, the receptacle including a deformable first wall, a lid arranged to move relative to the receptacle between an opened position uncovering the opening and a closed position covering the opening, and a lid lock coupled to the first wall and arranged to lock the lid in the closed position in response to inward deformation of the first wall into the interior region, wherein the lid lock includes a first locking tang coupled to the first wall for movement therewith and arranged to engage the lid in response to inward deformation of the first wall into the interior region, wherein receptacle includes a deformable second wall and the lid lock includes a second locking tang coupled to the second wall for movement therewith and arranged to engage the lid in response to inward deformation of the second wall into the interior region toward the first wall, and wherein the lid includes a lid rim formed to include a first step and a second step, the receptacle includes a first flange coupled to and extending outwardly from the first wall, a deformable second wall, and a second flange coupled to and extending outwardly from the second wall, the first flange and the first wall cooperate to define therebetween a first rim space for receiving the lid rim when the lid is positioned in the closed position, the second flange and the second wall cooperate to define therebetween a second rim space for receiving the lid rim when the lid is positioned in the closed position, the first locking tang extends upwardly from the first flange and inwardly toward the lid rim to engage the first step when the lid rim is received in the first rim space and the first wall is deformed inwardly toward the second wall, and the second locking tang extends upwardly from the second flange and inwardly toward the lid rim to engage the second step when the lid rim is received in the second rim space and the second wall is deformed inwardly toward the first wall.

10. The container of claim 9, wherein the receptacle includes a third wall connecting the first and second walls, the lid lock includes a first latch retainer cantilevered to the first flange and extending in front of the third wall, a second latch retainer cantilevered to the second flange and extending in front of the third wall, spaced-apart first and second latches, and an actuator cantilevered to the lid rim and coupled to and positioned between the first and second latches, the first latch is arranged to engage the first latch retainer and the second latch is arranged to engage the second latch retainer so that the first and second latches and the first and second latch retainers cooperate to lock the lid in the closed position upon movement of the lid from the opened position to the closed position, the actuator is arranged to move toward the third wall to release the first and second latches from the first and second latch retainers to unlock the lid.

* * * * *